US006913406B1

(12) United States Patent
Nocerino

(10) Patent No.: US 6,913,406 B1
(45) Date of Patent: Jul. 5, 2005

(54) FINGER INK

(76) Inventor: Gina A. Nocerino, 38 Circle Dr. North, Patchogue, NY (US) 11772

( * ) Notice: Subject to any disclaimer, the term of this patent is extended or adjusted under 35 U.S.C. 154(b) by 18 days.

(21) Appl. No.: 10/791,016

(22) Filed: Mar. 2, 2004

(51) Int. Cl.[7] ..... A46B 5/04
(52) U.S. Cl. ..... 401/7
(58) Field of Search ..... 401/6, 7, 8

(56) References Cited

U.S. PATENT DOCUMENTS

| | | | | | |
|---|---|---|---|---|---|
| 504,918 | A | * | 9/1893 | Geissinger | 401/7 |
| 684,685 | A | * | 10/1901 | Gerst | 401/7 |
| 2,151,846 | A | * | 3/1939 | Greneker | 81/177.3 |
| 2,989,807 | A | * | 6/1961 | Florence | 30/151 |
| 3,947,132 | A | * | 3/1976 | Fox | 401/7 |
| 4,738,556 | A | * | 4/1988 | Brown | 401/7 |
| 4,986,682 | A | * | 1/1991 | Lu | 401/7 |
| 5,529,415 | A | * | 6/1996 | Bishop | 401/7 |

* cited by examiner

*Primary Examiner*—David J. Walczak

(57) ABSTRACT

A writing instrument is comprised of an elongated, hollowed body that is cylindrical in shape, which extends and narrows into a tip for writing. Implement is worn directly upon a single finger by insertion through an opening at the upper or rear end of said body, and is constructed of durable yet flexible material. Writing implement also has an adjustable closure attached to its exterior, which extends laterally across body for a tighter or looser fit. The body is worn and extends approximately from knuckle to just past tip of finger. Toward lower end of said body, writing implement narrows past tip of finger and changes form into a harder material, the barrel, which begins the housing of a plastic, internal, ink tube or cartridge. The barrel attaches to and detaches from and equally hard and increasingly narrowing tip, through which the ink tube continues to extend internally. Finally the pointed, lower most end of said writing implement, is the tip from which the ink cartridge protrudes and permits writing. Movement of and exertion from finger inside this writing instrument allows for writing or drawing independent from gripping and the use of other fingers.

3 Claims, 1 Drawing Sheet

FINGER INK

CROSS-REFERENCE TO RELATED APPLICATIONS

Figure 1:
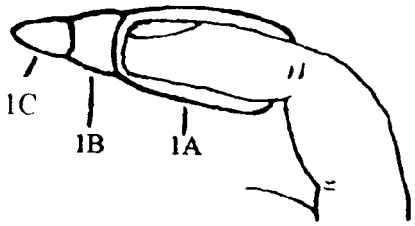

| | | |
|---|---|---|
| 6,550,068 | April 2003 | Materon 2/160 |
| 6,000,058 | December 1999 | Iselin 2/160 |
| 6,062,753 | May 2000 | Hadtke 401/6 |
| 5,853,210 | December 1998 | Robinson 294/25 |
| 4,526,547 | July 1985 | Rusk 434/166 |
| 6,637,962 | October 2003 | Roche 401/7 |
| 5,885,018 | March 1999 | Sato 401/8 |

Finger Ink is a writing device worn directly upon the finger. One continuous piece the base is a hollowed cavity, within which a finger is placed and can be accommodated by adjusting an attached Velcro closure to either tighten or loosen fit. The base extends from approximately the knuckle (varying depending upon finger length) to the tip of the finger. At the tip of the finger or the lower end of the base, begins the barrel, which houses internally the cartridge; the ink, ballpoint and ball make up the components of said cartridge. The barrel, or lowest end of base, is completed by an attachable and detachable tip, from which the cartridge extends and writing is executed via a protruding point.

STATEMENT REGARDING FEDERALLY SPONSORED RESEARCH OR DEVELOPMENT

NOT APPLICABLE

REFERENCE TO SEQUENCE LISTING, A TABLE, OR A COMPUTER PROGRAM LISTING COMPACT DISK APPENDIX

NOT APPLICABLE

BACKGROUND OF THE INVENTION

1. Field of the Invention

Finger ink is relatable generally to writing instruments.

2. Related Art

Conventionally straight, hand-held writing devices such as pens of common form and other marking devices such as markers or pencils are hard on the outside, similar in overall length and require use of more than one finger for writing. In addition they require a gripping, usually between index finger and thumb, and involve the middle finger as a support to absorb pressure during writing. These conventional styles do not allow the fingers to work or be used independently from one another, and gripping can become troublesome or bothersome, especially after continuous use.

Alternatives and improvements of these more traditional style-writing implements have been found among prior art and patents. U.S. Pat. Nos. 6,550,068, 6,000,058, 6,062,753, 5,853,210, 4,526,547, 6,637,962, and 5,885,018 are also writing implements however these devices are not free of gripping or other finger dependency, and are not worn upon or fully encompassing of the fingertip.

These patents are related very loosely within the general field of writing implements, but differ in more specific terms of use and construction. For example: U.S. Pat. Nos. 6,000,058, 6,062,753, 6,637,962, and 5,885,018 are among those that are not functional unless utilizing or aiding in grip; U.S. Pat. Nos. 4,526,547 and 5,853,210 are much more glove-like and cover or extend to multiple fingers or the whole hand. U.S. Pat. No. 6,550,068 is reliant upon all of the above, it is glove-like utilizing the whole of the hand, requires or aids in gripping, and in addition it is constructed of multiple prostheses. None of these patents are similar enough to falter the distinction of Finger Ink.

BRIEF SUMMARY OF THE INVENTION

The objects of the present writing implement are to fit directly upon finger, eliminate gripping, adjust, and to have key components that form a unified object.

The present writing implement is comprised of an elongated base, or body, with a writing point at the lowest end, and an open, upper end for encasing the finger approximately from the knuckle past the tip. Similar in function to a traditional writing implement, Finger Ink differs in size, shape, and overall in the ability to perform without the need of gripping or hand held strength. Worn individually upon a finger by insertion through the open end of the base, the writing implement fits approximately up to the knuckle, and can be adjusted or secured by use of a Velcro strap which extends laterally across said base. The barrel, or lower end of the base, begins past the fingertip and is the structure that contains the cartridge. Internally, the cartridge is a tube, which is inclusive of the ball, ballpoint and is filled with ink or other writing material. This cartridge is shared within the chambers of the barrel and the final component of the writing implement, which is the tip. The tip, like the barrel, has tread that allows the two to connect and comes to a point from which the cartridges ball and ballpoint protrude, and writing or drawing is accomplished. It begins and ends beyond the fingertip. The tip, when connected, is the lowest unifying end of this writing device.

BRIEF DESCRIPTION OF THE SEVERAL VEIWS OF THE DRAWING

FIG. 1 is a side profile of the device as fitted upon a finger.

| Includes components |
|---|
| 1A: Base<br>1B: Barrel<br>1C: Tip |

Figure 2:
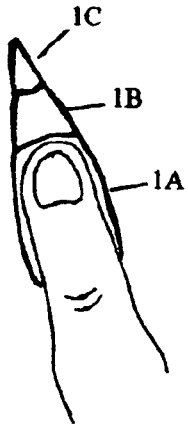

FIG. 2 is a top view of the device as fitted upon a finger.

| Includes components |
|---|
| 1A: Base<br>1B: Barrel<br>1C: Tip |

Figure 3:
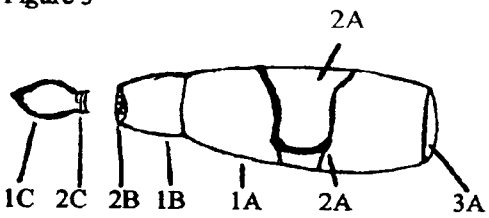

FIG. 3 is a profile of the apparatus with a Velcro closure and the separated tip-barrel to illustrate detachability/attachability.

| Includes components | |
|---|---|
| 1A: Base | 2A: Velcro adjustable strap closed<br>3A: Opening in base for insertion |
| 1B: Barrel | 2B: Internal tread at end closest to tip |
| 1C: Tip | 2C: External tread for attachment/detachment |

Figure 4:
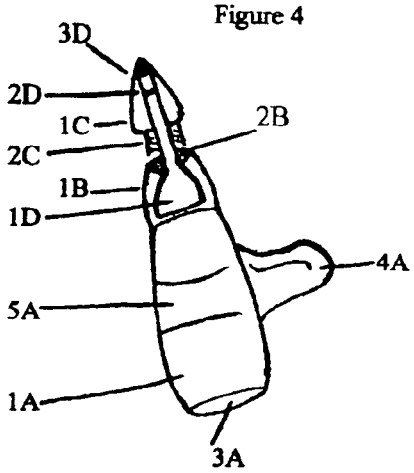

FIG. 4 is a top view of the device with Velcro closure and separated tip-barrel with internal cartridge exposed.

| Includes components | |
|---|---|
| 1A: Base | 3A: Opening in base for insertion<br>4A: Open Velcro strap<br>5A: Velcro stick track to secure closure |
| 1B: Barrel | placed over cartridge (internal) for connection<br>2B: Internal tread at end closest to tip |
| 1C: Tip | placed over cartridge (internal) for connection<br>2C: External tread for attachment/detachment |
| 1D: Cartridge | 2D: Ballpoint<br>3D: Ball |

Drawings are not exact in scale to size of actual writing apparatus or human finger.

DETAILED DESCRIPTION OF THE INVENTION

Finger Ink is a writing and/or drawing device worn as individual units upon one's finger. A finger is inserted into the base through an open end, a hollowed finger base, made up of trilaminate material, most likely a two-sided Nylon-Lycra with a middle layer of rubber. Much like the material of a "wetsuit", this is a flexible yet durable combination that will provide support for use while remaining comfortable and breathable. A strap for closure is stitched to external base material, made up of a Velcro strip which extends from one side across to a receiving Velcro stick track, allowing for a laterally adjustable connection which provides a tighter or loose fit as desired. The overall sizing is compact and may range in diameter based upon the closure, but length remains fairly constant, approximately 5 mm but actual manufacture may change this measurement. Variation due mostly to individual finger sizes, the writing implement's base is generally designed to fit up to the knuckle but may in some cases extend just below or above. At the lower and opposite end of the base, the material is closed off in a rounded or natural fingertip shape to protect and separate from contact with the barrel.

The barrel houses or contains the cartridge, which is where ink, ballpoint and ball are put together for actual writing or drawing function. The barrel is directly connected to the end of the base and is designed to start where the finger tip would end. These pieces cannot be separated, as they are one continuous writing implement that serves individually identifiable purposes to the user and in carrying out the overall function. The barrel is either a plastic or metal material as found on most common ballpoint pens and other writing implements. The barrel is cylindrical in shape, as is the base when worn around finger, and it is approximately 1 mm each in length and diameter. Color of the barrel may vary to match aesthetically with the base and illustrate the continuity of these components. Internally, the barrel has treading (in a clockwise or counterclockwise direction) at its end furthest from the base, which allows for the attachable, detachable and re-attachable final component.

DETAILED DESCRIPTION OF THE INVENTION—CONTINUED

The barrel is also the housing of a cartridge: an internal, plastic, fluid or ink-filled tube with ballpoint and ball at its end. This cartridge varies from standard pens or marking devices to fit the Finger Ink's compact size. It is approximately 2 mm in length and approximately 0.7 to 0.9 mm in diameter at its widest end (to consume almost the entire cavity of the barrel) and ranges from approximately 0.1 to 0.5 to 0.7 mm in diameter at its most narrowed end depending on the thickness or fineness of line desired, however actual measurements may vary with manufacture. The cartridge, which is the actual source of the fluid or ink, ball point and the ball (internal factors which are necessary to the flow and function of fluid or ink in writing and/or drawing) takes form as a cylinder narrowing into a point to fit consistently within the barrel of this device. The rest of this cartridge's function follows the overall standard patterns of ballpoint pens with a rotating brass or tungsten carbide ball contained at the end of this plastic tube (or cartridge) in a socket.

The final component in completion of the writing apparatus is the tip. Made of the same plastic or metal as the barrel, the tip of the Finger Ink is the protective shell that completes the shape and continuity of the writing implement, and from which the cartridge tip protrudes for writing or drawing to take place. The tip, which is approximately 2 mm in length, has a treaded end (clockwise or counterclockwise opposite of that inside the barrel) that is meant to attach or detach from the internal treading of the barrel, and receives the ballpoint-ball end of the cartridge within This treaded end is cylindrical but narrows into a pointed shape to its furthest end from the barrel. At its most pointed, narrow end the tip ranges in measurement of diameter and has a slightly smaller measurable hole from which the cartridge point extends out. This constitutes the final component of the Finger Ink forming a single, unified writing apparatus and is the end from which the actual writing or drawing is executed on to paper or other surface.

What I claim as my invention is:

1. A writing instrument adapted to be worn over the finger of a user comprising:

an elongated, flexible, cylindrical hollow body having an opening at a rear end thereof for receiving the finger of a user and a closed front end;

a barrel having an internal cavity and a first end positioned at said front end of said body;

a tip detachably connected to a second end of said barrel; and a tubular ink cartridge, said ink cartridge having a first end extending through said tip and having a ball therein for the application of ink and a second end positioned in said barrel, said first end having a smaller diameter than said second end such that said second end occupies substantially the entire cavity of said barrel.

2. A writing instrument as defined in claim 1 and further comprising a closure strap positioned on said body for sizing said body around the finger.

3. A writing instrument as defined in claim 1 wherein said body is formed from a trilaminate breathable material.

* * * * *